United States Patent [19]

Faulkner et al.

[11] 4,447,758

[45] May 8, 1984

[54] BROAD AREA CATHODE CONTACT FOR A PHOTOMULTIPLIER TUBE

[75] Inventors: Richard D. Faulkner, Lancaster; Dale V. Henry, Willow Street; David L. Muth, East Petersburg, all of Pa.

[73] Assignee: RCA Corporation, New York, N.Y.

[21] Appl. No.: 323,236

[22] Filed: Nov. 20, 1981

[51] Int. Cl.[3] ..... H01J 40/00

[52] U.S. Cl. ..... 313/532; 313/523

[58] Field of Search ..... 313/523, 524, 525, 526, 313/527, 528, 529, 530–544, 283, 292

[56] References Cited

U.S. PATENT DOCUMENTS

| | | | |
|---|---|---|---|
| 2,121,636 | 6/1938 | Koller | 250/27.5 |
| 2,160,593 | 5/1939 | Kling | 250/165 |
| 2,755,405 | 7/1956 | Wilhelm | 313/92 |
| 2,829,292 | 4/1958 | DeVere Krause | 313/82 |
| 2,829,293 | 4/1958 | Widmaier | 313/102 |
| 2,880,344 | 3/1959 | Stoudenheimer | 313/102 |
| 3,355,617 | 11/1967 | Schwartz et al. | 313/82 |
| 3,372,967 | 7/1966 | Hughes | 316/5 |
| 4,355,258 | 10/1982 | Butterwick | 313/533 |

*Primary Examiner*—David K. Moore
*Assistant Examiner*—Robert E. Wise
*Attorney, Agent, or Firm*—Eugene M. Whitacre; Dennis H. Irlbeck; Vincent J. Coughlin, Jr.

[57] ABSTRACT

A photomultiplier tube comprises an evacuated envelope having a generally cylindrical sidewall with a faceplate closing one end of the envelope. A conductive coating is disposed on a portion of the sidewall adjacent to the faceplate. A photocathode is formed on the faceplate and on a portion of the conductive coating. An electron multiplier assembly including a plurality of electrodes is spaced from the photocathode. A plurality of leads extend from the electrodes to a plurality of terminals in a base attached to the tube. A resilient electrical contact member is connected to a terminal in the base for applying a potential to the photocathode. The electrical contact member has a pair of support tabs at the opposite ends of the member. The tabs are affixed to the multiplier assembly so that the contact member assumes a substantially arcuate shape which contacts and conforms to a large area of the conductive coating on the sidewall of the envelope.

6 Claims, 4 Drawing Figures

BROAD AREA CATHODE CONTACT FOR A PHOTOMULTIPLIER TUBE

BACKGROUND OF THE INVENTION

The invention relates to a photomultiplier tube and particularly to an improved structure for electrically contacting a photocathode of a photomultiplier tube.

U.S. Pat. No. 2,829,293 issued to Widmaier on Apr. 1, 1958, shows a conventional point cathode contact member comprising a resilient wire which is biased to bear against a small area of a metal film which is evaporated onto the interior surface of a tube envelope adjacent to a faceplate. A photocathode which is formed on the faceplate slightly overlaps a portion of the metal film. A metal lead is connected between the resilient wire and the cathode lead which extends beyond the tube. Generally, the metal film is aluminum of nickel or some other easily evaporated metal which adheres well to glass. Conventional cathode contact members are either the point contact type described in the Widmaier patent or a tab-type contact member such as that shown in U.S. Pat. No. 2,160,593 issued to Kling on May 30, 1939 and in U.S. Pat. No. 3,372,967 issued to Hughes on Mar. 12, 1968. As shown in the Kling patent, the tab contact member bears upon a slightly larger area than the point contact member of Widmaier; however, each type of contact member relies on a biasing spring which is supported or affixed at one end to provide a cantilever electrical connection to the cathode. It is well known in the art that both point and tab-type cantilever contact members are electrically and mechanically unreliable and tend to physically abrade the metal film at the area of contact and eventually cause tube failure due to electrical arc-over or burn-through of the abraded metal film adjacent to the contact member.

SUMMARY OF THE INVENTION

A photomultiplier tube comprises an evacuated envelope having a generally cylindrical sidewall with a faceplate closing one end of the envelope. A conductive coating is disposed on a portion of the sidewall adjacent to the faceplate. A photocathode is formed on the faceplate and on a portion of the conductive coating. An electron multiplier assembly including a plurality of electrodes is spaced from the photocathode. Means are provided for applying potentials to the electrodes. Electrical connecting means is also provided for applying a potential to the photocathode. The electrical connecting means comprises a resilient conductive contact member having securing means at opposite ends thereof. The securing means are affixed to the multiplier assembly so that the resilient contact member assumes a substantially arcuate shape which contacts and coaxially conforms to the conductive coating on the sidewall of the envelope.

DESCRIPTION OF THE PREFERRED EMBODIMENT

Figure 1:
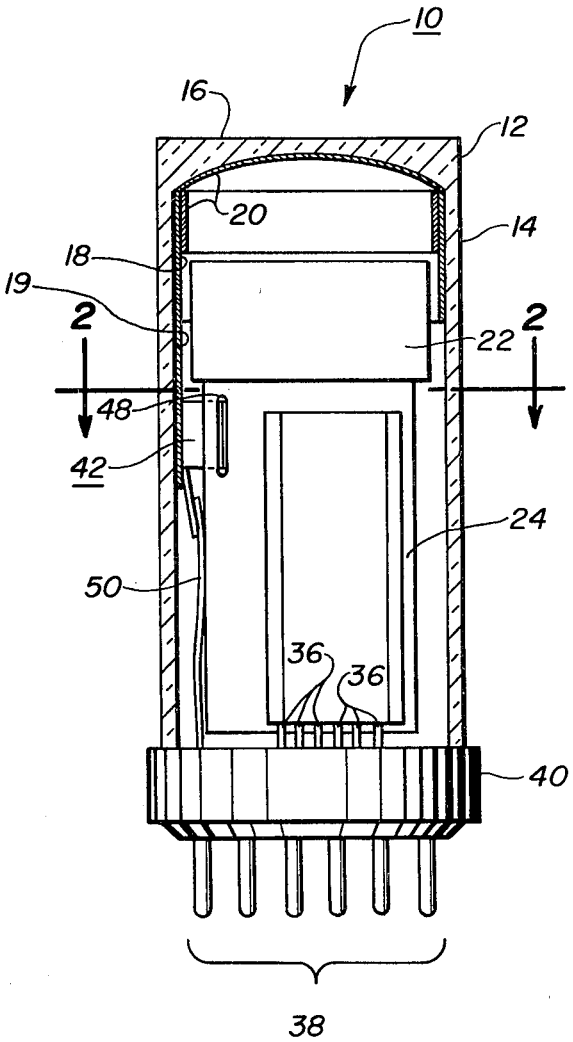
FIG. 1 is a partially cut-away side view of a photomultiplier tube in which an embodiment of the present invention is incorporated.

Referring to FIGS. 1 through 4, there is shown a photomultiplier tube 10 comprising an evacuated envelope 12 having a generally cylindrical sidewall 14 and a faceplate 16. An aluminized coating 18 is disposed on an interior surface portion of the sidewall 14 adjacent to the faceplate 16. The coating 18 also includes a projection 19 that extends longitudinally along a portion of the sidewall 14 for a reason to be discussed hereinafter. Within the tube 10 is a photoemissive cathode, hereinafter called a photocathode 20, on the interior surface of the faceplate 16 and also along a portion of the aluminum coating 18 on the sidewall 14. The photocathode 20 may be potassium-cesium-antimonide, for example, or any one of a number of photoemissive materials well known in the art. The photocathode 20 provides photoelectrons in response to radiation incident thereon.

The tube 10 is provided with a cup-shaped field forming electrode 22 which is spaced from the photocathode 20. The field forming electrode 22 is supported by a pair of oppositely-disposed dynode support insulators 24 and 24'. Typically, the spacing between the insulators is about 19 to 20 mm. The insulators 24 and 24' are substantially identical and comprise a ceramic material, such as Fotoceram manufactured by Corning Glass Company, Corning, N.Y., that has high mechanical strength.

An electron multiplier 26, comprising a primary dynode 28 and a plurality of secondary dynodes (only two of which are shown), is disposed between the photocathode 20 and an anode (not shown). The electron multiplier 26 is described in detail in copending U.S. patent application, Ser. No. 311,279 filed on Oct. 14, 1981, by Faulkner et al. The Faulkner et al. copending patent application is assigned to the assignee of the present invention and is incorporated herein for the purpose of disclosure. The secondary dynodes of the electron multiplier 26 are serially disposed in two substantially parallel columns 30 and 32. A secondary dynode 34 of the second column 32 of dynodes serves as the input secondary dynode for the electron multiplier 26 and is positioned to receive secondary electrons from the primary dynode 28 in a manner disclosed in the above-referenced Faulkner et al. copending patent application. The primary dynode 28 and the secondary dynodes of the electron multiplier 26 may be made of any conventional material such as, for example, beryllium-copper alloy. The dynodes and the photocathode are activated by a method well known in the art and described in copending U.S. patent appliction Ser. No. 132,659 filed on Mar. 21, 1980 by Faulkner et al., assigned to the same assignee as the present invention and incorporated herein for the purpose of disclosure.

The primary dynode 28, the secondary dynodes of the electron multiplier 26 and the anode are supported between the pair of oppositely-disposed support spacers 24 and 24' to form an electron multiplier assembly 35. A plurality of conductive lead members 36 (only some of which are shown) extend between the electrode 22, the primary dynode 28, the secondary dynodes, the anode, and a plurality of terminals 38 in a base 40 attached to the tube 10. Potentials are applied to the various tube elements from an external source (not shown) through the terminals 38.

Figure 4:
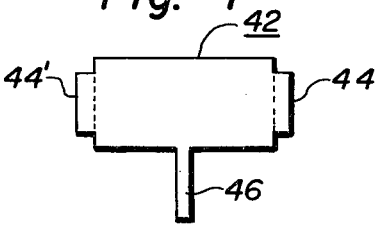
FIG. 4 is a plan view of the novel cathode contact member.

Electrical connection to the photocathode 20 is provided by a novel contact member 42. The contact member 42 comprises a thin, resilient strip of metal, such as a nickel alloy. The contact member 42 may be formed, e.g., by punching or stamping, a 0.559 mm (0.0022 inch) thick blank having initial dimensions of about 31.75 mm×31.75 mm and a Rockwell "C" hardness of about 40–45. As shown in FIG. 4, the contact member 42 includes a pair of support tabs 44 and 44' formed in opposite ends of the member 42. An electrical contact tab 46 is formed along one edge of the member about midway between the tabs 44 and 44'. While the above-described location of the contact tab 46 is preferred in this embodiment, it should be clear to one skilled in the art that the contact tab 46 may be located anywhere on the contact member 42, or the contact tab can be eliminated and electrical connection made directly to the contact member 42.

Figure 2:
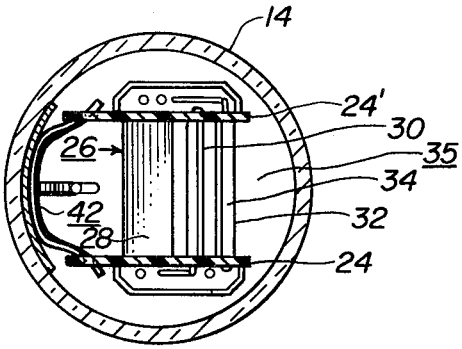
FIG. 2 is a section view along lines 2—2 of FIG. 1 showing the broad area cathode contact obtained using an embodiment of the present invention.
Figure 3:
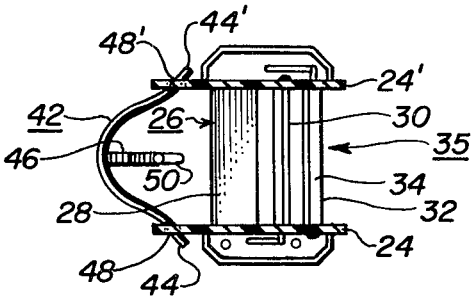
FIG. 3 shows the arcuate shape of the novel contact member when affixed to the support insulators.

During assembly of the tube 10, the support tabs 44 and 44' of the contact member 42 are disposed within a pair of attachment slots 48 and 48' formed in the support insulators 24 and 24', respectively. The lateral dimension of the resilient contact member 42 is greater than the distance between the support insulators 24 and 24'; therefore, the contact member bows outwardly. The arcuate shape of the assembled contact member is shown in FIG. 3. As shown in FIGS. 1 and 2, the contact member 42 maintains its substantially arcuate shape when inserted into the envelope 12. The contact member 42 contacts and conforms to a large area of the projection 19 of the conductive coating 18 that extends longitudinally along a portion of the cylindrical sidewall 14. A cathode lead 50 is attached at one end to the electrical contact tab 46 of the contact member 42 and at the other end to one of the terminals 38 in the base 40.

The present novel contact member 42 thus provides a broad area cathode contact that is affixed at opposite ends by tabs 44 and 44' to the support insulators 24 and 24', respectively, and is compressively urged against the conductive projection 19 on the envelope sidewall. The novel broad area cathode contact structure described herein provides a more reliable and wear resistant contact than the point or tab-type contacts of the prior art.

What is claimed is:

1. In a photomultiplier tube comprising an evacuated envelope having a generally cylindrical sidewall with a faceplate closing one end of said envelope, a conductive coating disposed on a portion of said sidewall adjacent to said faceplate, a photocathode formed on said faceplate and on a portion of said conductive coating, an electron multiplier assembly including a plurality of electrodes spaced from said photocathode, means for applying potentials to said electrodes of said electron multiplier assembly, and electrical contact means for applying a potential to said photocathode, the improvement wherein said electrical contact means comprises a resilient conductive contact member having securing means at opposite ends thereof, said securing means being affixed to said multiplier assembly so that said resilient contact member assumes a substantially arcuate shape which contacts and coaxially conforms to said conductive coating on said sidewall of said envelope.

2. In a photomultiplier tube comprising an evacuated envelope having a generally cylindrical sidewall with a faceplate closing one end of said envelope, a conductive coating disposed on an interior surface of said sidewall adjacent to said faceplate and extending longitudinally along a portion of sidewall, an anode spaced from said photocathode, an electron multiplier disposed between said cathode and said anode, a pair of oppositely-disposed insulating support spacers for supporting said electron multiplier and said anode, means for applying potentials to said electron multiplier and said anode, and electrical contact means for applying a potential to said photocathode, the improvement wherein each of said insulating support spacers include an attachment slot formed therethrough, and said electrical contact means includes a resilient conductive cathode contact member having a pair of support tabs formed in opposite ends thereof, said cathode contact member having a lateral dimension substantially greater than the lateral spacing between said insulating support spacers so that said cathode contact member assumes a substantially arcuate shape which causes said contact member to be compressively urged against and to coaxially conform to said conductive coating extending longitudinally along a portion of said sidewall when said support tabs are disposed within said attachment slots in said support spacers.

3. The tube as in claims 1 or 2, wherein said contact member includes an electrical contact tab formed along one edge thereof.

4. The tube as in claim 3, wherein said contact member comprises a strip of resilient metal.

5. The tube as in claim 3, wherein said contact member comprises a nickel alloy.

6. The tube as in claim 3, wherein said contact member has a thickness of about 0.559 mm and a Rockwell "C" hardness of about 40–45.

* * * * *